United States Patent [19]

Kratel et al.

[11] 4,359,496

[45] Nov. 16, 1982

[54] HEAT-INSULATING BOARD AND METHOD FOR PRODUCING SAME

[75] Inventors: Günter Kratel, Durach-Bechen; Hans Katzer, Kempten, both of Fed. Rep. of Germany

[73] Assignee: Wacker-Chemie GmbH, Munich, Fed. Rep. of Germany

[21] Appl. No.: 277,245

[22] Filed: Jun. 25, 1981

[30] Foreign Application Priority Data

Sep. 5, 1980 [DE] Fed. Rep. of Germany ..... 3033515

[51] Int. Cl.[3] ..... B32B 3/04; B32B 3/06; B32B 5/16

[52] U.S. Cl. ..... 428/75; 156/216; 156/226; 156/227; 156/213; 428/126; 428/192; 428/469; 428/76

[58] Field of Search ..... 428/328, 329, 59, 57, 428/60, 61, 74, 75, 76, 124, 125, 126, 127, 128, 129, 192, 469; 156/216, 226, 227

[56] References Cited

U.S. PATENT DOCUMENTS

| | | | |
|---|---|---|---|
| 3,140,220 | 7/1964 | Walter | 428/126 |
| 3,519,523 | 7/1970 | Rodman et al. | 428/126 |
| 3,785,913 | 1/1974 | Hallamore | 428/76 |
| 3,874,983 | 4/1975 | Hay et al. | 428/126 |
| 4,061,815 | 12/1977 | Poole, Jr. | 428/215 |
| 4,122,203 | 10/1978 | Stahl | 428/328 |
| 4,287,245 | 9/1981 | Kikuchi | 428/60 |
| 4,298,387 | 11/1981 | Kratel et al. | 501/92 |

*Primary Examiner*—William J. Van Balen

*Attorney, Agent, or Firm*—Allison C. Collard; Thomas M. Galgano

[57] ABSTRACT

The invention relates to a heat-insulating board which has a core and a cover. The core is composed of compacted, finely particulate metal oxide and, optionally, additions of opacifier and fibrous material. The cover is composed in part of metal foil arranged on those faces that are to be directed against the heat flow. The remainder of the cover is composed of a material that inhibits heat flow. A method for manufacturing the board is also disclosed.

6 Claims, 2 Drawing Figures

HEAT-INSULATING BOARD AND METHOD FOR PRODUCING SAME

Figure 1:
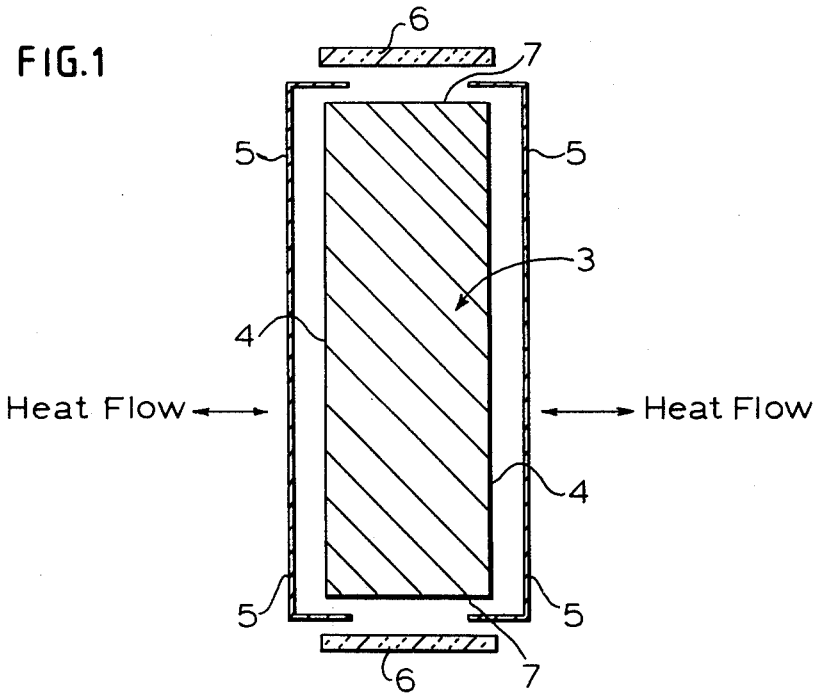

The invention relates to a heat-insulating board, as well as a method for producing the same, which board has a cover and a core of compacted heat-insulating material of the following composition:

30 to 100% by weight of a finely particulate metal oxide;

0 to 50% by weight of an opacifier; and 0 to 20% by weight of fibrous material.

It is customary, in the manufacture of heat-insulating boards, for the particulate heat-insulating material to be compacted, for example by pressing. In this connection, the addition of relatively large quantities of binder, which would make it possible to manufacture self-supporting boards, is undesirable, because the heat-insulating properties would suffer.

It has therefore been previously proposed to put the heat-insulating material into sack-like covers of, for example, glass fiber and the like, and by sewing or welding and subsequent pressing, to manufacture a board in which it is possible to dispense with the binder. However, heat-insulating boards of this kind often have seams or ridges at their edges which adversely affect their dimensional accuracy. Consequently, difficulties often arise in assembly, especially when joining several boards together.

Heat-insulating boards which are completely covered by sheet metal or metal foil are also known in the art. These types of boards are, for the most part, adapted to suit very special applications within the broad field of heat insulation.

Metals reflect heat radiation and, to this extent, exhibit insulating properties. On the other hand, however, owing to their good heat conductivity, they unfortunately contribute to the heat flow.

The object of the invention is therefore to develop a heat-insulating board having a metal cover, which does not possess the above-described disadvantages.

This object is achieved according to the invention by the provision of a heat-insulating board which is characterized in that the cover comprises at least two different materials, wherein:

(a) faces of the board that are to be directed against the heat flow are covered with metal foil;

(b) the metal foils do not touch each other; and (c) the metal foils are connected by a material that inhibits heat flow.

Other objects and features of the present invention will become apparent from the following detailed description when taken in connection with the accompanying drawing which discloses several embodiments of the invention. It is to be understood that the drawing is designed for the purpose of illustration only and is not intended as a definition of the limits of the invention.

Figure 2:
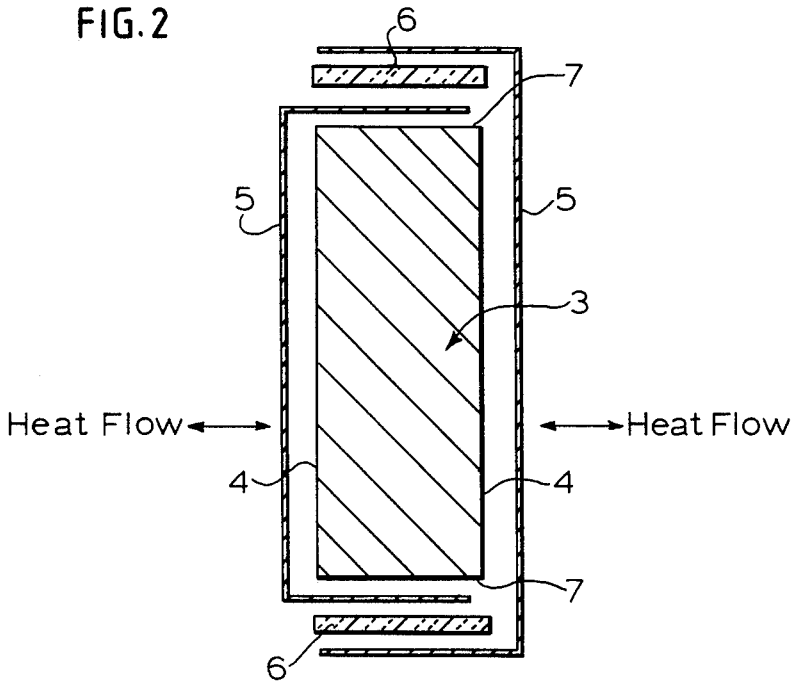

In the drawing, wherein similar reference characters denote similar elements throughout the several views:

FIG. 1 is a cross-sectional view through a heat-insulating board according to one embodiment of the invention; and FIG. 2 is a cross-sectional view through a heat-insulating board according to another embodiment of the invention.

Referring now in detail to the drawing, a heat-insulating board is provided having a core 3 which is lined, on the faces 4 to be directed against the heat flow, with metal foil 5. As can be seen from the drawing, the metal foil 5 is preferably folded over the face edges and extends beyond the edge, to any desired degree. It is, however, imperative that the two metal foils 5 do not touch each other. To complete the board cover, the metal foils 5 are connected to a cover element 6 made of a material that inhibits heat flow.

FIG. 1 shows an example of a board according to the invention, in which that part of the board cover that inhibits heat flow, i.e., cover element 6, is situated over the ends of the metal foils 5. In contrast thereto, according to FIG. 2, the metal foils 5 extend over the greater portion of the end face 7 of the board, so that a sandwich substructure composed of a series of layers—namely, metal foil/heat-flow-inhibiting material/-metal foil, is produced.

The junction between the metal foil 5 and core 3 consisting of compacted heat-insulating material is preferably free from adhesive, at least on those faces of the board that are to be directed against the heat flow. If desired, a mechanical joint can be made between the metal foil 5 and the core 3, for example, by appropriate impression.

Between cover element 6 which completes the cover and inhibits heat flow and metal foils 5, there is a firm—usually adhesive—joint.

Suitable adhesives for this purpose are, e.g., water glass which, to modify its viscosity, contains fumed silica and, optionally, fibrous reinforcing means. Maleinate/vinyl acetate copolymers have proven successful as organic adhesives.

In another embodiment, the above-mentioned firm joint is brought about by bracing, i.e., it can be effected mechanically. This can be done, for example, by bracing around the board a strip of polymeric material selected from the group of fluorocarbons. In addition, a mechanical connection may be formed using clips.

The following composition has proven successful as heat-insulating material for the heat-insulating boards according to the invention:

30 to 100% by weight of a finely particulate metal oxide;

0 to 50% by weight of an opacifier; and 0 to 20% by weight of a fibrous material.

Preferred finely particulate metal oxides within the scope of the present invention are precipitated silicas poor in alkali or fumed silicas, including electric-arc silicas. Other examples are finely particulate or micropore types of aluminum oxide and titanium dioxide. The metal oxides can be used by themselves or in admixture with each other. The metal oxides have BET specific surface areas of from 50 to 700 $m^2/g$, preferably from 70 to 400 $m^2/g$.

Examples of opacifiers are ilmenite, titanium dioxide, silicon carbide, iron(II)-iron(III) mixed oxide, chromium dioxide, zirconium oxide, manganese dioxide and ferric oxide. The opacifiers advantageously have an absorption maximum in the infrared range of between 1.5 and 10 $\mu$m.

The fibrous material used is, inter alia, glass wool, rock wool, slag wool, ceramic fibers, such as those obtained from melts of aluminum oxide and/or silicon oxide, or asbestos fibers.

The heat-insulating material is produced simply by mixing together the components in the desired composition. It is, however, also possible to use so-called agglomerated mixtures, especially those based on fumed silica. The procedure in such a case is to add the opacifier continuously, in the desired mixture ratio, during the manufacture of the silica, while the silica is still in the form of primary particles (see U.S. application Ser. No. 102,510 filed Dec. 11, 1979, now U.S. Pat. No. 4,298,387).

As metal foil, aluminum foil is preferred. It is, however, possible, especially for more specific applications, to use any other metal foil that has also been used hitherto to cover heat-insulating materials. The foils are usually from 10 to 80 μm, preferably approximately 40 μm, in thickness.

The material that completes the board cover and inhibits heat flow may be of woven fabric or, e.g., glass fibers or asbestos. For special applications, polymeric material based on fluorocarbons, or a film-forming coating, such as water glass, can be used. It is, however, always a non-metallic material.

A preferred process for the manufacture of the heat-insulating board according to the invention is characterized by the following process steps:

(1) pressing the heat-insulating material to form a board;

(2) lining those faces of the board that are to be directed against the heat flow with a metal foil; and (3) completing the board cover by affixing a material that inhibits heat flow.

To manufacture the heat-insulating board according to the invention, the heat-insulating material is poured into a mold and pressed, preferably at a pressure of approximately 10 kgf/cm$^2$. During pressing, the gases entrapped in the mixture should be able to escape. For this reason, pressing is preferably carried out under reduced pressure. De-gassing can also take place or begin even before pressing. The compacted core is then provided with metal foil, which is folded over the edges, and the cover is completed by attaching a material, preferably in strip-form, that inhibits heat flow. Depending on the material, this can be done by gluing, bracing or fitting clips, but preferably by gluing.

A possible modification of the process consists of affixing the metal foils during the actual pressing of the heat-insulating material. The preferred procedure in this case is to introduce one of the two metal foils into the mold, pre-compact the heat-insulating material, apply the second metal foil to the pre-compacted heat-insulating material, and finally press the workpiece to its final form.

Furthermore, during the described prefabrication of the board core in its final form, the non-metallic part of the board cover can be applied to the core or between the metal foils.

The heat-insulating boards according to the invention are distinguished by outstanding heat-insulating properties, which are achieved by the combination of the following features:

(1) selecting an appropriate composition for the heat-insulating material;

(2) dispensing with the binder in the heat-insulating material;

(3) lining the core with metal foil on those faces of the board that are to be directed against the heat flow; and (4) connecting the metal foils by a non-metallic material which inhibits heat flow.

A further advantage is the good dimensional accuracy of the boards. The fact that the boards according to the invention can easily be shaped to provide sharp edges ensures clean-jointed assembly.

Finally, it should be mentioned that the inventive idea not only includes heat-insulating boards having a flat shape but also those boards having a curved shape.

Thus, while only several embodiments of the present invention have been shown and described, it will be obvious that many changes and modifications may be made thereto, without departing from the spirit and scope of the invention.

The embodiments of the invention in which an exclusive property or privilege is claimed are defined as follows:

1. A heat-insulating board comprising:

a board-shaped core of compacted heat-insulating inorganic material of the following composition:

30 to 100% by weight of a finely particulate metal oxide;

0 to 50% by weight of an opacifier; and 0 to 20% by weight of a fibrous material; and a cover comprising at least two different materials including two non-contacting metal foils, each of which cover an opposite face of said board-shaped core which is to be directed against the heat flow and at least two cover elements made of a heat-insulating material which connects said metal foils together.

2. A process for the manufacture of a heat-insulating board, comprising a core of heat-insulating material and a cover comprising at least two different materials, the steps comprising:

(a) pressing the heat-insulating material to form a board composed of compacted heat-insulating inorganic material comprising 30 to 100% by weight of a finely particulate metal oxide, 0 to 50% by weight of an opacifier, and 0 to 20% by weight of a fibrous material;

(b) covering each of the opposite faces of the board which are to be directed against the heat flow with a metal foil in such a manner that said foils do not contact one another; and (c) completing the board cover by affixing to said metal foils a material which inhibits heat flow.

3. The board according to claim 1, wherein said foils each have at least two opposite inturned edge portions, each of which overlie at least a portion of an opposite edge of the board.

4. The board according to claim 3, wherein said cover elements each overlie an opposite edge of said board and the edge portions of said foils associated therewith.

5. The board according to claim 3, wherein said edge portions of each foil extend over almost the full width of the associated board edges and wherein said cover elements are interposed between said edge portions so as to define a three-ply construction comprising an edge portion of one metal foil, said cover element and an edge portion of the other metal foil.

6. The board according to claim 1, wherein said core is rectangular.

* * * * *

UNITED STATES PATENT AND TRADEMARK OFFICE

CERTIFICATE OF CORRECTION

PATENT NO. : 4,359,496

DATED : NOVEMBER 16, 1982

INVENTOR(S) : KRATEL ET AL.

It is certified that error appears in the above—identified patent and that said Letters Patent is hereby corrected as shown below:

Cover page, [75] Inventors, after "Kempten,", insert -- Hans-Peter Kalmuk, Kempten--; change "both" to --all--.

Signed and Sealed this

*Eleventh* Day of *January 1983*

[SEAL]

*Attest:*

GERALD J. MOSSINGHOFF

*Attesting Officer*

*Commissioner of Patents and Trademarks*